US007561011B2

(12) United States Patent
Takubo et al.

(10) Patent No.: US 7,561,011 B2
(45) Date of Patent: Jul. 14, 2009

(54) DIELECTRIC DEVICE

(75) Inventors: Osamu Takubo, Tokyo (JP); Kouji Tashiro, Tokyo (JP); Kazuyoshi Terao, Tokyo (JP); Ryohei Nakano, Tokyo (JP)

(73) Assignee: TDK Corporation, Tokyo (JP)

( * ) Notice: Subject to any disclaimer, the term of this patent is extended or adjusted under 35 U.S.C. 154(b) by 385 days.

(21) Appl. No.: 11/523,603

(22) Filed: Sep. 20, 2006

(65) Prior Publication Data

US 2008/0231391 A1 Sep. 25, 2008

(30) Foreign Application Priority Data

Sep. 20, 2005 (JP) ..... 2005-272784

(51) Int. Cl.
*H01P 1/201* (2006.01)
*H01P 1/213* (2006.01)
*H01P 7/04* (2006.01)

(52) U.S. Cl. ..... 333/202; 333/134; 333/206

(58) Field of Classification Search ..... 333/134, 333/202, 203, 206, 207, 219, 222
See application file for complete search history.

(56) References Cited

U.S. PATENT DOCUMENTS 5,731,746 A * 3/1998 Sokola et al. ..... 333/134
6,034,579 A * 3/2000 Tada et al. ..... 333/202
6,727,784 B2 * 4/2004 Endou et al. ..... 333/206
2002/0030559 A1 3/2002 Motoharu et al.

FOREIGN PATENT DOCUMENTS

| | | |
|---|---|---|
| EP | 1 298 758 A2 | 4/2003 |
| JP | 9-162608 | 6/1997 |
| JP | 10-93311 | 4/1998 |
| JP | 3329450 | 7/2002 |

OTHER PUBLICATIONS

U.S. Appl. No. 11/546,252, filed Oct. 12, 2006, Takubo et al.

* cited by examiner

*Primary Examiner*—Seungsook Ham
(74) *Attorney, Agent, or Firm*—Oblon, Spivak, McClelland, Maier & Neustadt, P.C.

(57) ABSTRACT

A dielectric device includes a dielectric substrate and a resonator unit. The resonator unit includes first and second holes. The first hole opens on a first surface of the dielectric substrate and extends toward a second surface opposite to the first surface. A first internal conductor is provided inside the first hole. The second hole opens on a third surface of the dielectric substrate, extends toward a fourth surface opposite to the third surface, and is connected to the first hole. A second internal conductor is provided inside the second hole with one end connected to an external conductor film on the third surface and the other end connected to the first internal conductor. The first hole has a recess opposed to a junction with the second hole. The first internal conductor in the recess is opposed to the external conductor film on the fourth surface across the dielectric substrate.

23 Claims, 18 Drawing Sheets

DIELECTRIC DEVICE

BACKGROUND OF THE INVENTION

1. Field of the Invention

The present invention relates to a dielectric device such as a dielectric resonator or a dielectric filter/duplexer composed thereof.

2. Description of the Related Art

Dielectric devices are used in a high-frequency range such as sub-microwave band, microwave band, millimeter wave band, or sub-millimeter wave band. More specific examples of applications include satellite communication devices, mobile communication devices, wireless communication devices, high-frequency communication devices, or base stations for such communication devices. The dielectric devices of this type are required to be miniaturized.

Japanese Patent No. 3329450 discloses a dielectric device whose resonator unit is composed of first and second holes provided in a dielectric substrate. The first hole opens on a first surface of the dielectric substrate and extends toward a second surface that is opposite to the first surface. The second hole has one end opening on a third surface that is not opposite to the first surface. The other end of the second hole is connected to the first hole in a T-junction form.

In such a T-junction hole configuration, the physical length corresponding to $\lambda/2$ or $\lambda/4$ is a sum of the length of the first hole and the length of the second hole. Therefore, unlike in the case of providing a single straight hole in the dielectric substrate, the desired physical length can be obtained by adjusting the length of one hole to compensate for the length of the other hole. Thus, the length of the dielectric substrate can be shortened to achieve miniaturization.

As described above, the T-junction hole configuration enables shortening the length of the dielectric substrate to achieve miniaturization, but further miniaturization is expected. For further miniaturization, it is also expected to modify the T-junction hole configuration to lower resonant frequency without sacrificing easiness of production.

SUMMARY OF THE INVENTION

It is an object of the present invention to provide a dielectric device which permits miniaturization with lowered resonant frequency, but without sacrificing easiness of production.

First Aspect

According to a first aspect of the present invention, there is provided a dielectric device comprising: a dielectric substrate; at least one resonator unit; and at least one terminal.

The dielectric substrate is shaped to have first and second surfaces opposed to each other in a first direction and third and fourth surfaces opposed to each other in a second direction perpendicular to the first direction. The dielectric substrate has an external conductor film at least on the second, third and fourth surfaces.

The resonator unit includes first and second holes. The first hole is provided in the dielectric substrate, extends along the first direction with one end thereof opening on the first surface, and has a first internal conductor inside thereof.

The second hole is provided in the dielectric substrate, extends along the second direction with one end thereof opening on the third surface and the other end thereof connected to the first hole, and has a second internal conductor inside thereof. The second internal conductor has one end thereof connected to the external conductor film on the third surface and the other end thereof connected to the first internal conductor inside the dielectric substrate.

The first hole extends beyond a junction with the second hole to have an extension opposed to the second surface. The terminal is provided on the second surface, separated from the external conductor film by a gap, and opposed to the first internal conductor in the extension of the first hole across the dielectric substrate.

The first hole has a recess opposed to the junction along the second direction. The first internal conductor in the recess is opposed the external conductor film on the fourth surface across the dielectric substrate.

In the dielectric device according to the present invention, as described above, the first and second surfaces of the dielectric substrate are opposed to each other in the first direction; the third and fourth surfaces of the dielectric substrate are opposed to each other in the second direction perpendicular to the first direction. The resonator unit includes the first and second holes. The first hole extends along the first direction with one end opening on the first surface. The second hole extends along the second direction with one end opening on the third surface and the other end connected to the first hole. This provides a hole configuration with the second hole meeting the first hole at its inside end opposite to the outside end opening on the third surface. Therefore, unlike in the case of providing a single straight hole in the dielectric substrate, the desired physical length can be obtained by adjusting the length of one hole to compensate for the length of the other hole. Thus, the length of the dielectric substrate can be shortened to achieve miniaturization.

The present invention is further characterized in that the first hole has the recess opposed to the junction along the second direction and that the first internal conductor in the recess is opposed the external conductor film on the fourth surface across the dielectric substrate, which generates an electrostatic capacitance between the first internal conductor in the recess and the external conductor film on the fourth surface. Hence, as compared with dielectric devices not having such a recess, the dielectric device according to the present invention can be suited to much lower resonant frequency without changing the size of the dielectric substrate. In other words, a desired resonant frequency can be obtained while achieving miniaturization of the dielectric substrate.

In addition, since the recess is opposed to the junction along the second direction, a single rod-like mold may be adopted for forming the recess and the second hole at the same time in a production process. For example, the dielectric substrate of the above configuration may be produced with only three molds: a frame for forming the external shape of the dielectric substrate; a first rod-like mold for forming the first hole; and a second rod-like mold for forming the second hole and the recess. This ensures the easiness of production.

The recess may have an inner diameter equal to or smaller than that of the second hole. In either case, the easiness of production can be ensured by adopting a single rod-like mold for forming the recess and the second hole at the same time.

The dielectric device according to the present invention may be used as a wide variety of devices including a resonator, an oscillator, a dielectric filter, and a duplexer (also referred to as an antenna duplexer). When used as a resonator, among those applications, the device may be completed with one resonator unit. When used as a dielectric filter or duplexer, the device needs a plurality of resonator units. This will be described below with reference to concrete embodiments.

According to one embodiment, the first internal conductor may be separated from the external conductor film on the first surface by a gap. With this configuration, the resonator unit operates as a λ/4 resonator.

According to another embodiment, the first internal conductor may be connected to the external conductor film on the first surface. With this configuration, the resonator unit operates as a λ/2 resonator.

According to still another embodiment, the resonator unit comprises a plurality of resonator units electrically coupled with each other via the dielectric substrate. With this configuration, the dielectric device may be used as a dielectric filter or duplexer.

In at least one of the resonator units, preferably, the second hole has a larger-diameter portion and a smaller-diameter portion, wherein the larger-diameter portion has one end thereof opening on the third surface, the smaller-diameter portion has one end thereof connected to the other end of the larger-diameter portion, and the other end of the smaller-diameter portion is connected to the first hole. With this configuration, excellent formability of the dielectric material can be ensured at the junction of the first and second holes by the smaller-diameter portion, while interstage capacitive coupling of adjacent resonator units can be increased by the larger-diameter portion, thereby widening the band of a dielectric filter or duplexer.

When used as a dielectric filter, the terminal may comprise first and second terminals, which may be used as an input-output terminal. The first terminal may be opposed to the first hole of one resonator unit across the dielectric substrate. The second terminal may be opposed to the first hole of another resonator unit across the dielectric substrate. Both the first and second terminals are isolated from the external conductor film.

When used as a duplexer, the resonator unit may comprise at least three resonator units and the terminal may comprise first, second and third terminals. The first, second and third terminals may be electrically coupled with different resonator units and used as an antenna terminal, a receive terminal, and a transmit terminal.

Second Aspect

According to a second aspect of the present invention, there is provided a dielectric device comprising: a dielectric substrate; and at least one resonator unit.

The dielectric substrate is shaped to have first and second surfaces opposed to each other in a first direction and third and fourth surfaces opposed to each other in a second direction perpendicular to the first direction. The dielectric substrate has an external conductor film at least on the second, third and fourth surfaces.

The resonator unit includes first and second holes. The first hole is provided in the dielectric substrate, extends along the first direction with one end thereof opening on the first surface, and has a first internal conductor inside thereof. The first internal conductor is separated from the external conductor film on the first surface by a gap.

The second hole is provided in the dielectric substrate, extends along the second direction with one end thereof opening on the third surface and the other end thereof connected to the first hole, and has a second internal conductor inside thereof. The second internal conductor has one end thereof connected to the external conductor film on the third surface and the other end thereof connected to the first internal conductor inside the dielectric substrate.

The first hole extends beyond a junction with the second hole to have an extension opposed to the second surface. The first hole has a recess opposed to the junction along the second direction. The first internal conductor in the recess is opposed the external conductor film on the fourth surface across the dielectric substrate.

The dielectric device according to the second aspect of the invention has the same effects and advantages as the dielectric device according to the first aspect of the invention.

As has been described hereinabove, the present invention provides a dielectric device which permits miniaturization with lowered resonant frequency, but without sacrificing easiness of production.

The present invention will be more fully understood from the detailed description given hereinbelow and the accompanying drawings which are given by way of illustration only, and thus are not to be considered as limiting the present invention.

DESCRIPTION OF THE PREFERRED EMBODIMENTS

Figure 1:
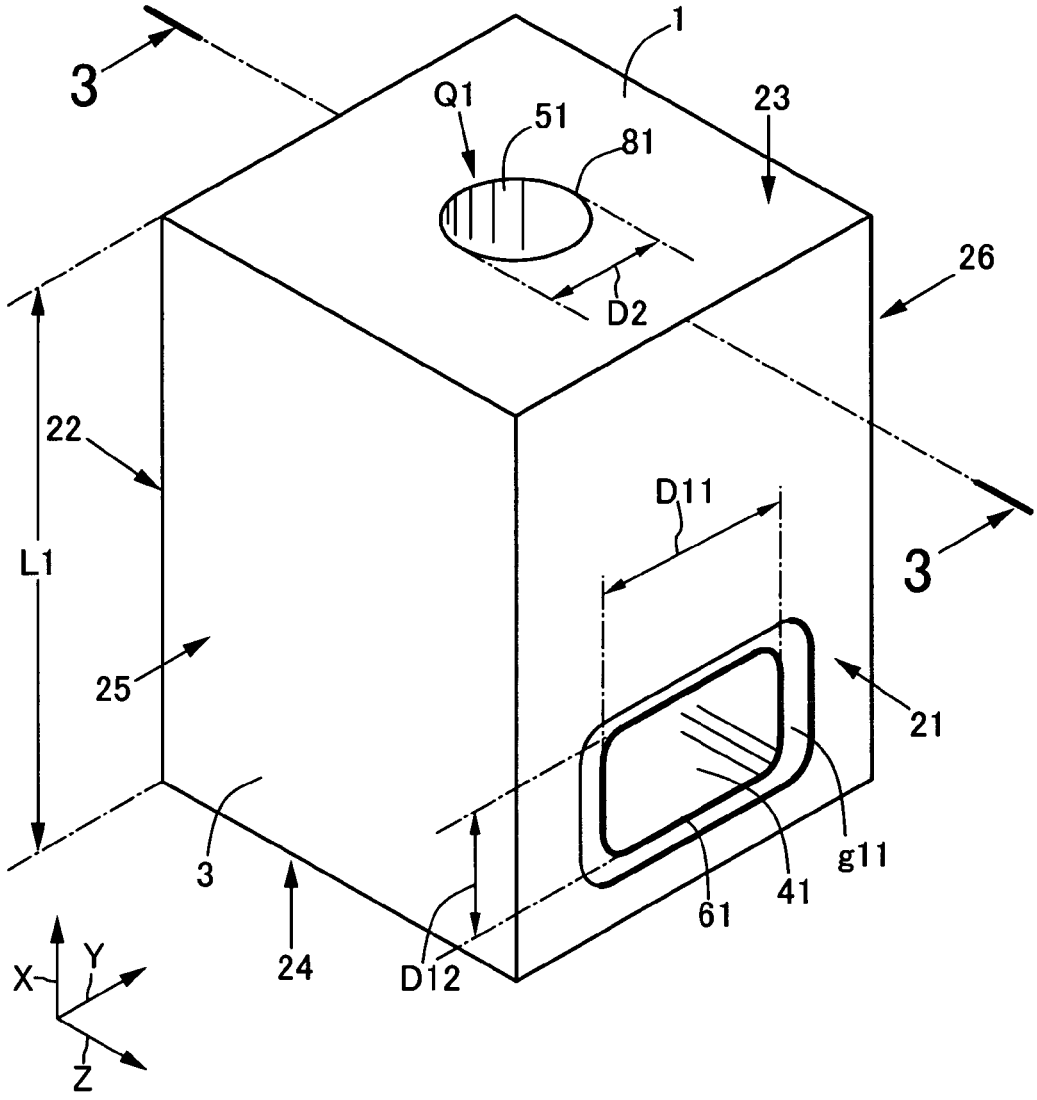
FIG. 1 is a perspective view showing a dielectric resonator according to one embodiment of the present invention.
Figure 2:
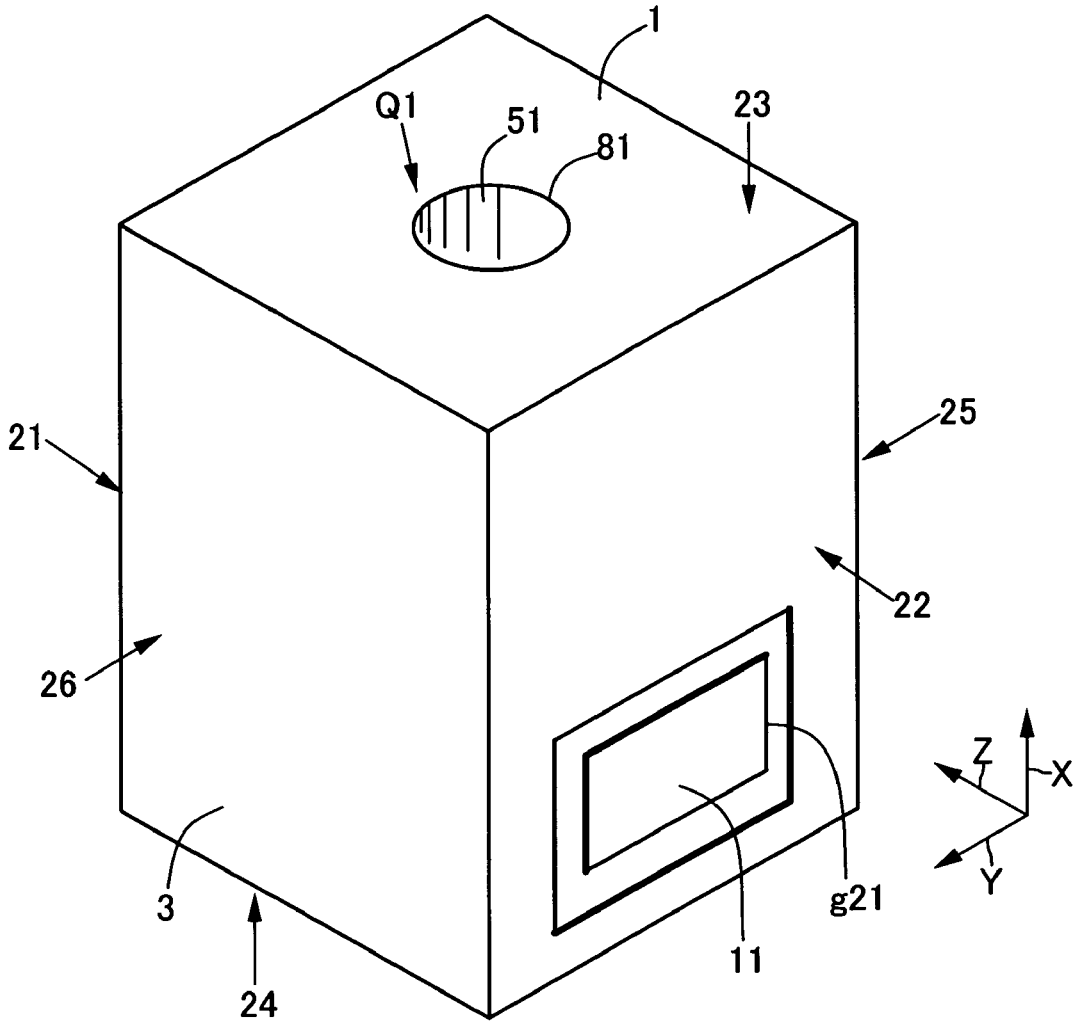
FIG. 2 is a perspective view of the dielectric resonator shown in FIG. 1, as seen from a rear side thereof.

Hereinbelow preferred embodiments of the present invention will be described with reference to the accompanying drawings. Each embodiment may be embodied according to either or both of the first and second aspects of the present invention.

FIGS. 1 to 4 illustrate a dielectric resonator as a dielectric device according to one embodiment of the present invention. The illustrated dielectric resonator includes a dielectric substrate 1 and a single resonator unit Q1.

The dielectric substrate 1 is shaped to have length, width and thickness directions X, Y, Z. More specifically, the dielectric substrate 1 is formed from a well-known dielectric ceramic to have a generally hexahedral shape with first and second surfaces 21, 22 opposed to each other in the thickness direction Z, third and fourth surfaces 23, 24 opposed to each other in the length direction X, fifth and sixth surfaces 25, 26 opposed to each other in the width direction Y. Of the dielectric substrate 1, most of the second to sixth surfaces 22 to 26 are covered with an external conductor film 3. Typically, the external conductor film 3 may be formed by baking, plating or the like to contain copper, silver or the like as a main component.

The resonator unit Q1 includes first and second holes 41, 51. The first hole 41 is provided in the dielectric substrate 1 and extends along the thickness direction Z with one end opening on the first surface 21.

The first hole 41 has a first internal conductor 61 inside thereof. The first internal conductor 61 may be formed as an electrode film from the same material and by the same means as the external conductor film 3. Alternatively, the first internal conductor 61 may be formed by filling a part or the whole of the first hole 41. In the illustrated embodiment, the first internal conductor 61 is separated from the external conductor film 3 on the first surface 21 by a gap g11, but it is also possible that the first internal conductor 61 is connected to the external conductor film 3 on the first surface 21.

The second hole 51 is also provided in the dielectric substrate 1 and extends along the length direction X with one end opening on the third surface 23. The other end of the second hole 51 is connected to the first hole 41 inside the dielectric substrate 1.

The second hole 51 has a second internal conductor 81 inside thereof. The second internal conductor 81 has one end connected to the external conductor film 3 on the third surface 23 and the other end connected to the first internal conductor 61 inside the dielectric substrate 1. The second internal conductor 81 may be formed from the same material and by the same means as the first internal conductor 61. Alternatively, the second internal conductor 81 may be formed by filling a part or the whole of the second hole 51.

The second hole 51 is of a substantially circular shape with an inner diameter D2. The first hole 41 is of a generally rectangular shape, of which an inner diameter D11 along the width direction Y is larger than an inner diameter D12 along the length direction X. The inner diameter D11 along the width direction Y is larger than the inner diameter D2 of the second hole 51. Therefore, the second hole 51 is connected to the first hole 41 with its inside end within the width of the first hole 41. The first hole 41 preferably has rounded corners. Although D11 is larger than D12 in the illustrated embodiment, D12 may be larger than D11.

Figure 3:
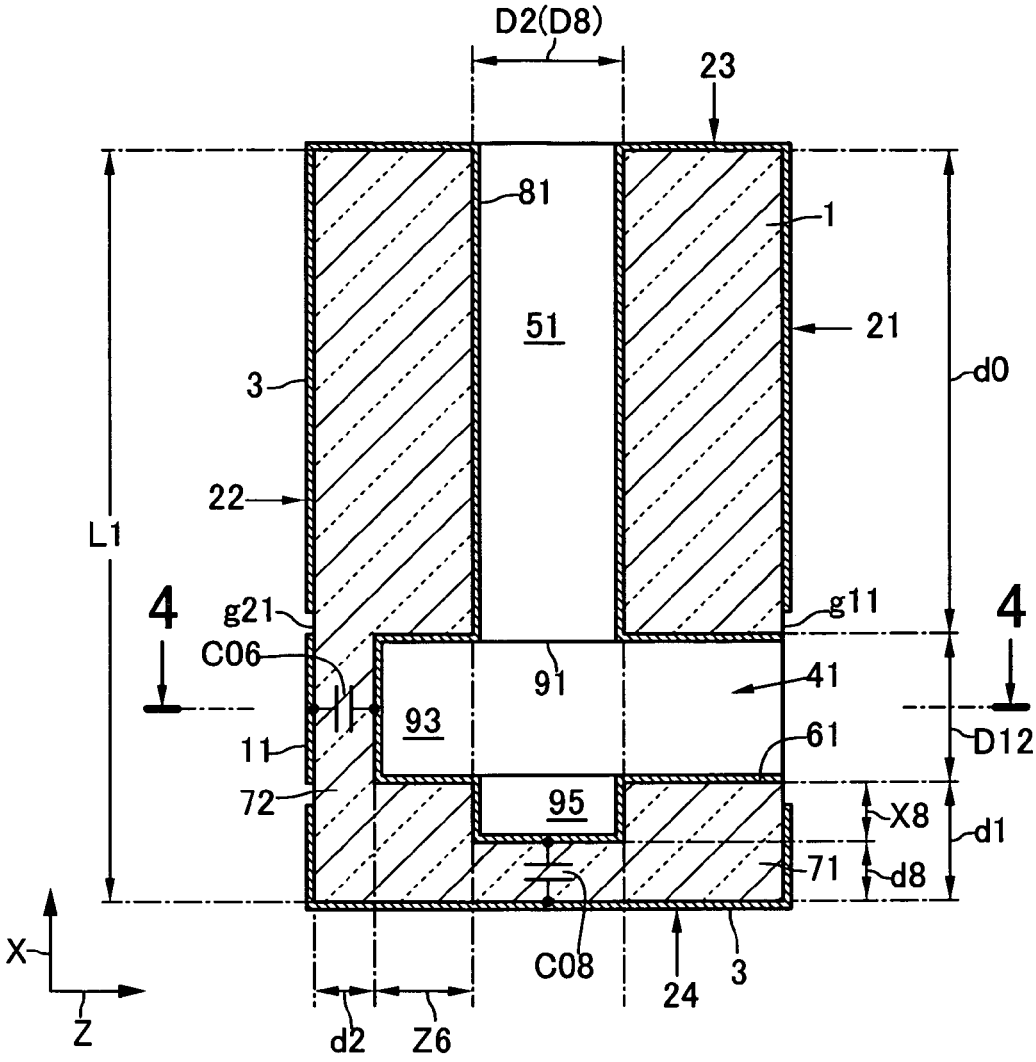
FIG. 3 is a cross-sectional view taken along line 3-3 in FIG. 1.

A distance d0 between the first hole 41 and the third surface 23 on which the second hole 51 opens is larger than a distance d1 between the first hole 41 and the fourth surface 24 (see FIG. 3). That is, d0 is larger than d1.

Figure 4:
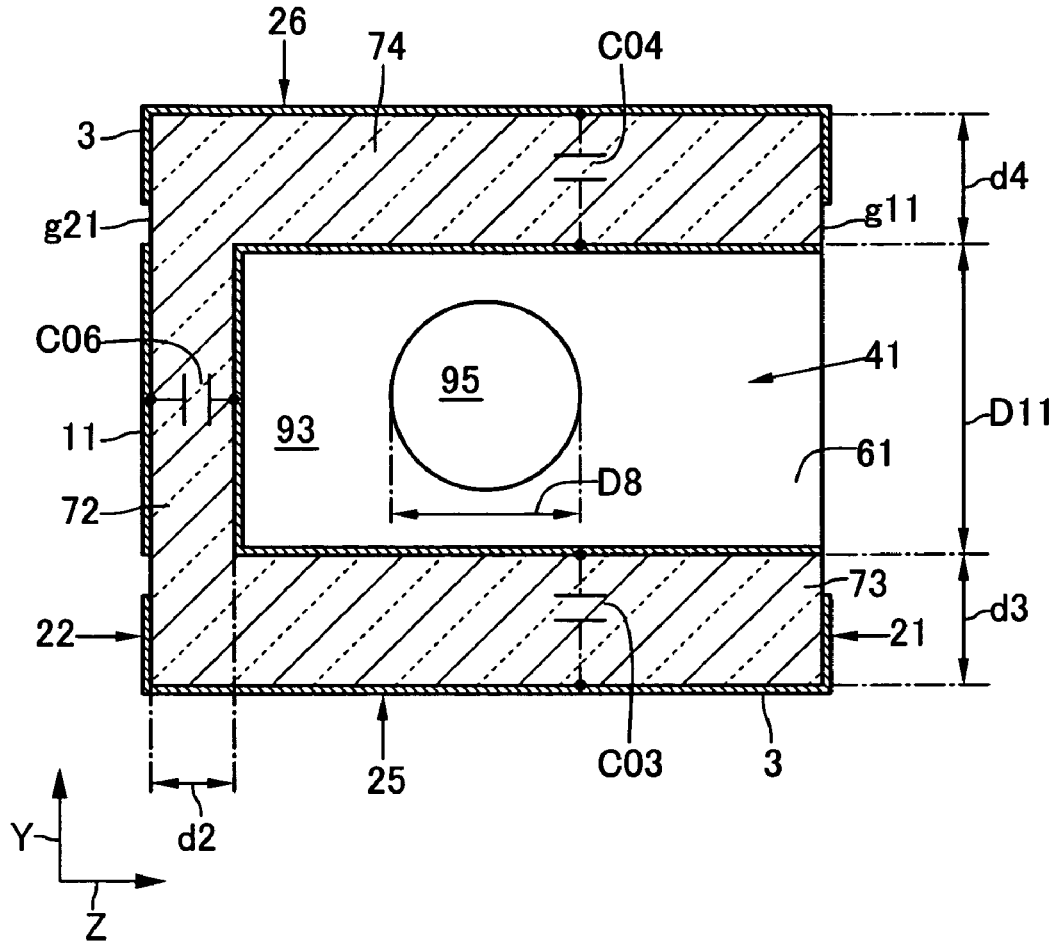
FIG. 4 is a cross-sectional view taken along line 4-4 in FIG. 3.

Dielectric layers 71 to 74 with thicknesses d1 to d4 are present between the first internal conductor 61 on the inner surface of the first hole 41 and the external conductor film 3 on the second surface 22 and the fourth to sixth surfaces 24 to 26 (see FIGS. 3 and 4).

The first hole 41 extends a distance Z6 beyond a junction 91 with the second hole 51 to have an extension 93 opposed to the second surface 22 (see FIG. 3). The extension 93 of the first hole 41 also has a generally rectangular shape with the inner diameter D11 along the width direction Y and the inner diameter D12 along the length direction X (see FIGS. 3 and 4).

The second surface 22 has a first terminal 11, which is separated from the external conductor film 3 by an insulating gap g21. Across the dielectric layer 72 with the thickness d2, the first terminal 11 is opposed to the first internal conductor 61 in the extension 93 of the first hole 41. More specifically, the first terminal 11 is coupled with the first internal conductor 61 by an electrostatic capacitance C06 via the dielectric layer 72. If desired, the first terminal 11, which is provided on the second surface 22 in the illustrated embodiment, may extend from the second surface 22 to the fourth surface 24.

The first hole 41 has a recess 95 (see FIGS. 3 and 4). The recess 95 is opposed to the junction 91 along the length direction X. The recess 95 is recessed a depth X8 toward the fourth surface 24. As seen in a plane perpendicular to the length direction X, the recess 95 is located within the second hole 51. The recess 95 has the same shape as the second hole 51. More specifically, the recess 95 is of a substantially circular shape with an inner diameter D8 that is equal to the inner diameter D2 of the second hole 51.

Across the dielectric layer 71 with a thickness d8, the first internal conductor 61 in the recess 95 is opposed to the external conductor film 3 on the fourth surface 24. More specifically, the first internal conductor 61 in the recess 95 is coupled with the external conductor film 3 by an electrostatic capacitance C08 via the dielectric layer 71.

As described with reference to FIG. 3, the resonator unit Q1 includes the first and second holes 41, 51. The first hole 41 extends along the thickness direction Z with one end opening on the first surface 21. The second hole 51 extends along the length direction X with one end opening on the third surface 23 and the other end connected to the first hole 41. This provides a hole configuration with the second hole 51 meeting the first hole 41 at its inside end opposite to the outside end opening on the third surface 23. Therefore, unlike in the case of providing a single straight hole in the dielectric substrate, the desired physical length can be obtained by adjusting the length of one hole to compensate for the length of the other hole. Thus, the length of the dielectric substrate can be shortened to achieve miniaturization and height reduction.

Furthermore, the first hole 41 has the recess 95 opposed to the junction 91 along the length direction X and the first internal conductor 61 in the recess 95 is opposed the external conductor film 3 on the fourth surface 24 across the dielectric layer 71 with the thickness d8, which generates the electrostatic capacitance C08 between the first internal conductor 61 in the recess 95 and the external conductor film 3 on the fourth surface 24. Hence, as compared with dielectric resonators not having such a recess, the illustrated dielectric resonator can be suited to much lower resonant frequency without changing the size of the dielectric substrate 1. In other words, a desired resonant frequency can be obtained while achieving miniaturization of the dielectric substrate 1.

In addition, since the recess 95 is opposed to the junction 91 along the length direction X, a single rod-like mold may be adopted for forming the recess 95 and the second hole 51 at the same time in a production process. For example, the dielectric substrate 1 of the above configuration may be produced with only three molds: a frame for forming the external shape of the dielectric substrate 1; a first rod-like mold for forming the first hole 41; and a second rod-like mold for forming the second hole 51 and the recess 95. More specifically, the first and second rod-like molds may be used for formation of the dielectric substrate 1 in assembled relation and then pulled out of the dielectric substrate 1. This ensures the easiness of production.

Next, experimental data will be described.

Samples 1 to 5 were prepared in accordance with the configuration of the dielectric resonator illustrated in FIGS. 1 to 4. The dielectric substrate 1 was formed from a dielectric material of a relative dielectric constant $\in r=36.8$ into a generally rectangular parallelepiped shape. The external dimensions of the dielectric substrate 1 were such that the plane area of the third surface 23 was (3.3 mm×1.65 mm) and the length L1 was 4.15 mm. The inner diameter D2 of the second hole 51 was 0.5 mm. The inner diameter D12 of the first hole 41 along the length direction X was 0.5 mm, and the distance d0 between the first hole 41 and the third surface 23 was 3.15 mm. The length Z6 of the extension 93 from the junction 91 was 0.5 mm. The inner diameter D8 of the recess 95 was equal to the inner diameter D2 of the second hole 51, i.e., 0.5 mm.

In this configuration, the depth X8 of the recess 95 was set at 0 mm, 0.1 mm, 0.2 mm, 0.3 mm, 0.4 mm for Samples 1, 2, 3, 4, 5, respectively. It should be noted that the depth=0 mm means that the recess 95 was not provided in Sample 1.

Figure 5:
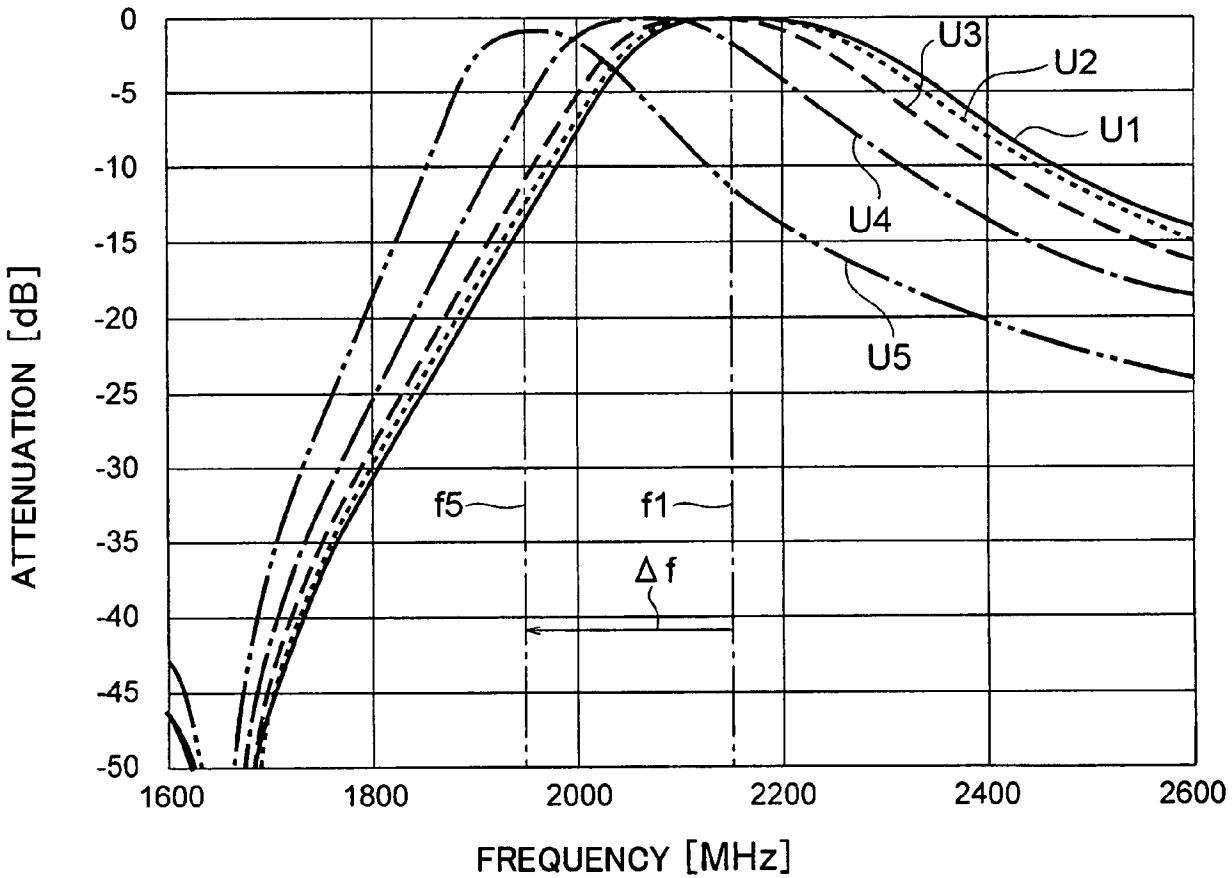
FIG. 5 is a diagram showing frequency attenuation characteristics of Samples 1 to 5.

FIG. 5 is a diagram showing frequency attenuation characteristics of Samples 1 to 5. In the diagram, frequency (Hz) is plotted in abscissa and attenuation (dB) is plotted in ordinate, whereby the characteristics of Samples 1 to 5 are shown as curves U1 to U5, respectively. As understood from the date of FIG. 5, Samples 2 to 5 with the recess were suited to much lower resonant frequencies than Sample 1 with no recess, without changing the size of the dielectric substrate. For instance, Sample 1 had a resonant frequency f1 of 2,315 MHz and Sample 5 had a resonant frequency f5 of 1,952 MHz, wherein Sample 5 was shifted to the resonant frequency f5 that was lower than the resonant frequency f1 of Sample 1 by $\Delta f$.

As also understood from the date of FIG. 5, the resonant frequency lowers with increasing the depth X8 of the recess 95.

Figure 6:
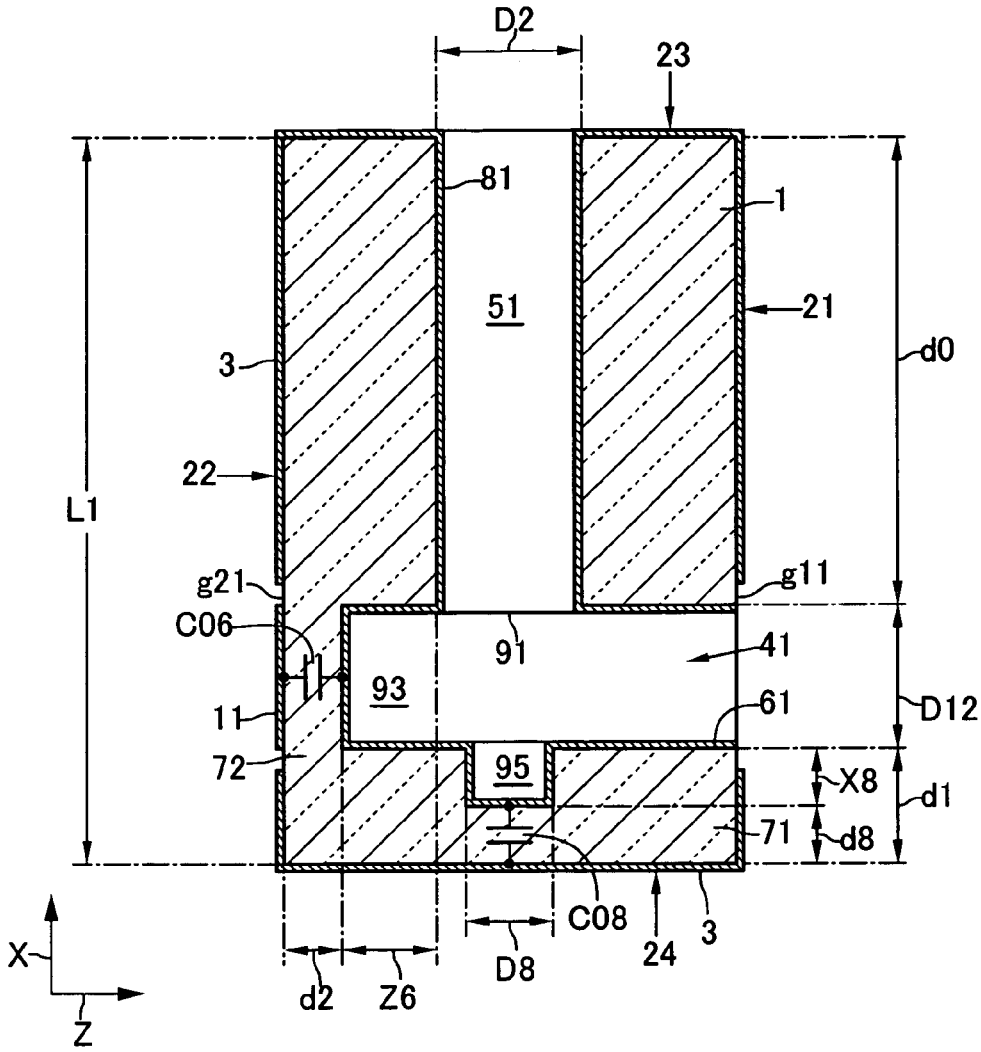
FIG. 6 is a cross-sectional view showing a dielectric resonator according to another embodiment of the present invention.

FIG. 6 is a cross-sectional view showing a dielectric resonator according to another embodiment of the present invention. In this drawing, the components similar to those shown in FIGS. 1 to 4 are designated by the same reference symbols, and redundant explanation is omitted.

In contrast to the embodiment illustrated in FIGS. 1 to 4, the inner diameter D8 of the recess 95 in the embodiment illustrated in FIG. 6 is smaller than the inner diameter D2 of the second hole 51. Even in this configuration, the rod-like mold for forming the recess and the second hole at the same time may be adopted to ensure the easiness of production.

Figure 7:
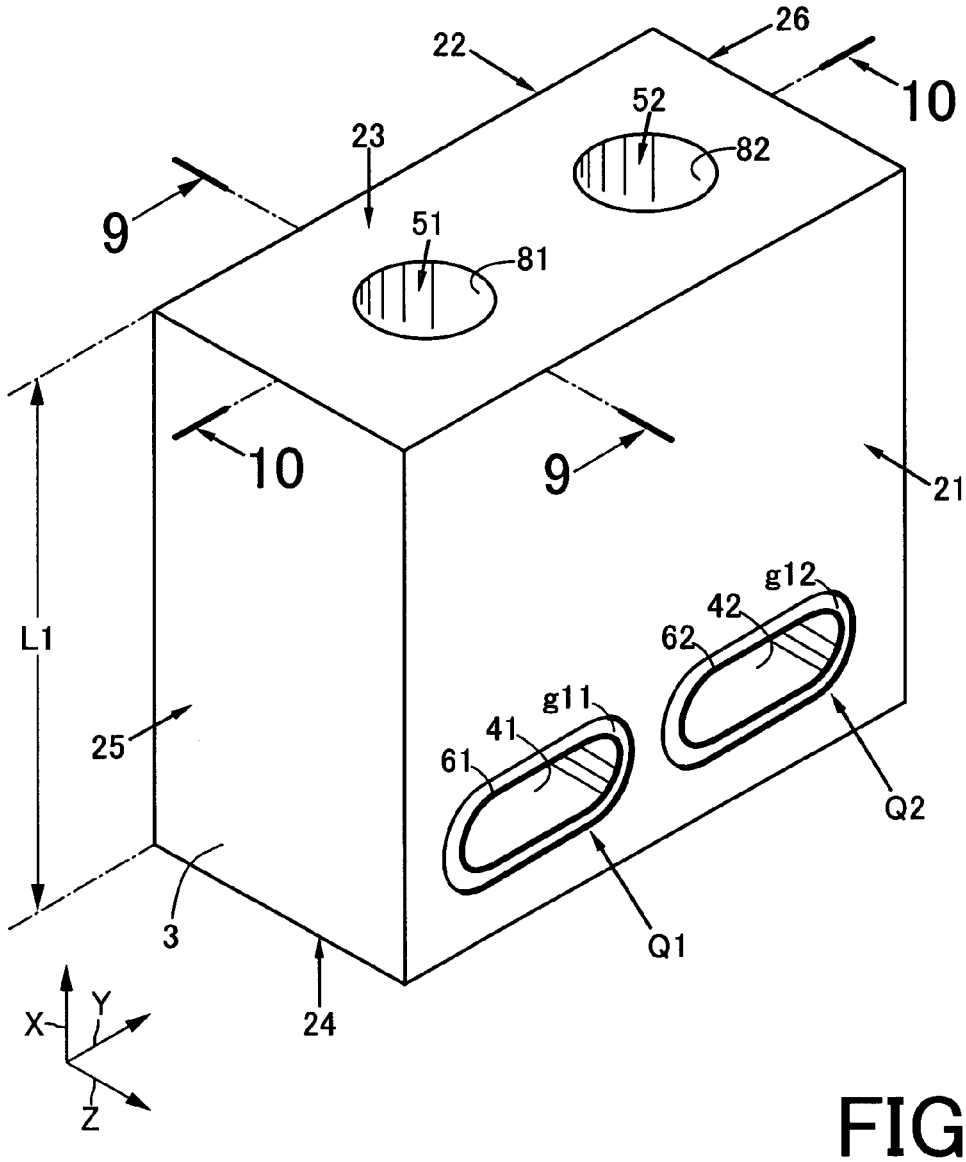
FIG. 7 is a perspective view showing a dielectric filter according to still another embodiment of the present invention.
Figure 8:
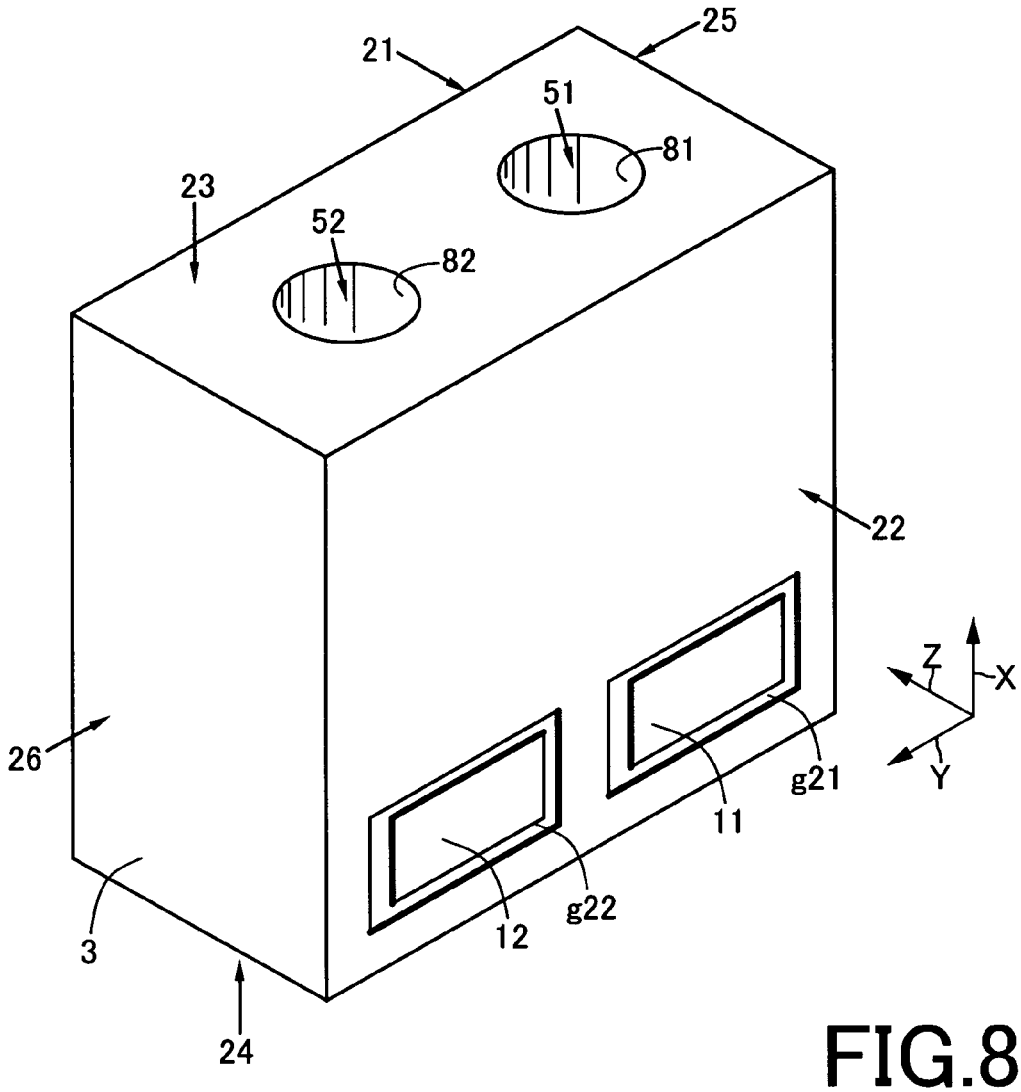
FIG. 8 is a perspective view of the dielectric filter shown in FIG. 7, as seen from a rear side thereof.
Figure 9:
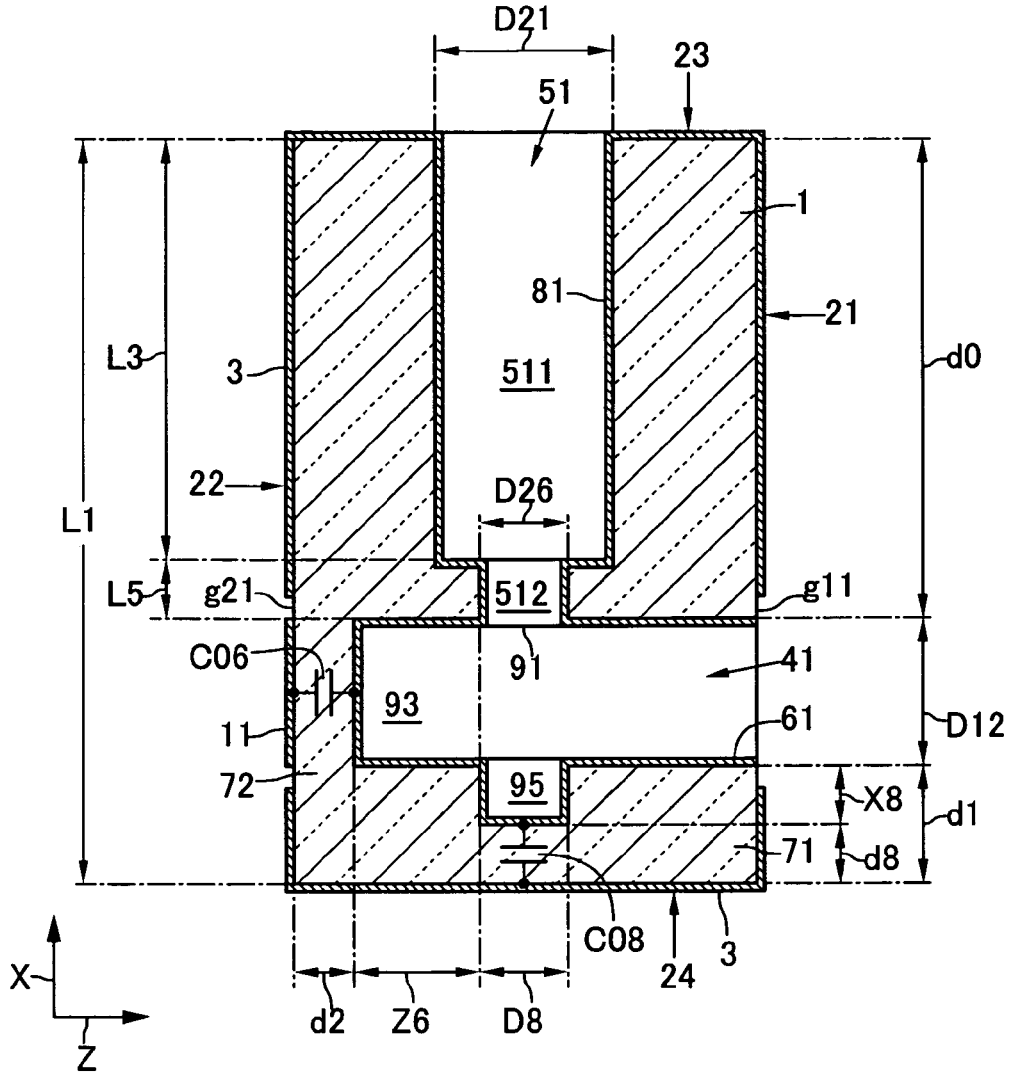
FIG. 9 is a cross-sectional view taken along line 9-9 in FIG. 7.
Figure 10:
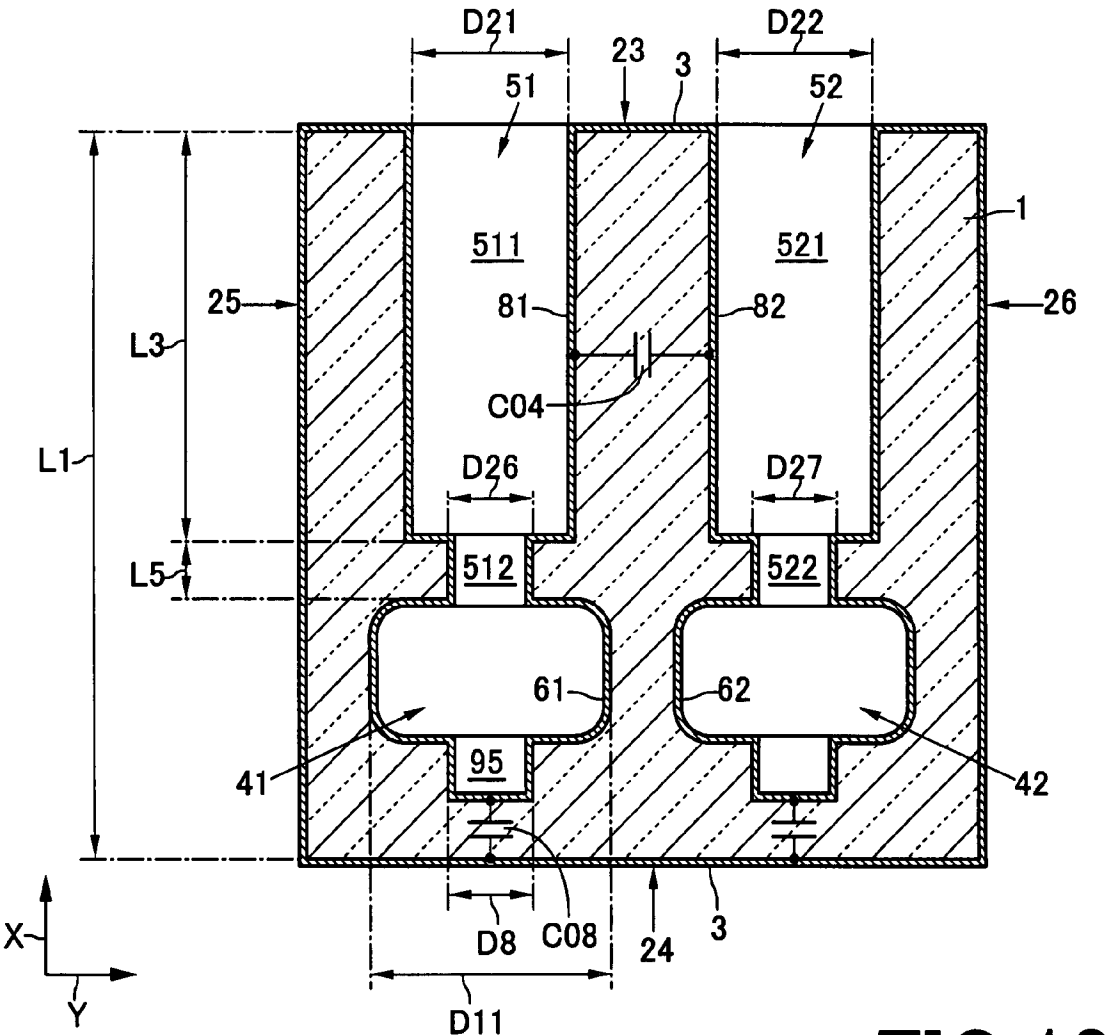
FIG. 10 is a cross-sectional view taken along line 10-10 in FIG. 7.

FIG. 7 is a perspective view showing a dielectric filter according to still another embodiment of the present invention; FIG. 8 is a perspective view of the dielectric filter shown in FIG. 7, as seen from a rear side thereof; FIG. 9 is a cross-sectional view taken along line 9-9 in FIG. 7; and FIG. 10 is a cross-sectional view taken along line 10-10 in FIG. 7. In these drawings, the components similar to those shown in the foregoing drawings are designated by the same reference symbols, and redundant explanation is omitted.

The illustrated dielectric filter includes one dielectric substrate 1 and two resonator units Q1, Q2. The resonator units Q1, Q2 share the dielectric substrate 1 and are integrated via the dielectric substrate 1.

The resonator unit Q1 includes first and second holes 41, 51. The resonator unit Q2 includes first and second holes 42, 52. The first holes 41, 42 and the second holes 51, 52 of the resonator units Q1, Q2 may adopt any of the configurations illustrated in and described with reference to FIGS. 1 to 6.

For example, the first and second holes 41, 51 of the resonator unit Q1 may be configured as follows: the first hole 41 extends along the thickness direction Z with one end opening on the first surface 21 and has the first internal conductor 61 inside thereof, wherein the first internal conductor 61 is separated from the external conductor film 3 on the first surface 21 by the gap g11 (see FIGS. 7 and 9); the second hole 51 extends along the length direction X with one end opening on the third surface 23 and the other end connected to the first hole 41 inside the dielectric substrate 1 and has the second internal conductor 81 inside thereof, wherein the second internal conductor 81 has one end connected to the external conductor film 3 on the third surface 23 and the other end connected to the first internal conductor 61 inside the dielectric substrate 1 (see FIGS. 7 and 9).

In the illustrated embodiment, both the first holes 41, 42 of the resonator units Q1, Q2 are configured to have the recess shown in FIG. 3 or 6, but they should not be construed as limited thereto. For example, only one of the first holes 41, 42 may be configured to have the recess.

In this embodiment, furthermore, the second hole 51 is configured to have a larger-diameter portion 511 and a smaller-diameter portion 512. The larger-diameter portion 511 extends along the length direction X with one end opening on the third surface 23. The larger-diameter portion 511 is of a substantially circular shape with an inner diameter D21.

The smaller-diameter portion 512 extends along the length direction X with one end connected to the other end of the larger-diameter portion 511. The other end of the smaller-diameter portion 512 is connected to the first hole 41. The smaller-diameter portion 512 is of a substantially circular shape with an inner diameter D26, which is smaller than the inner diameter D21 of the larger-diameter portion 511. For example, the inner diameter D21 of the larger-diameter portion 511 and the inner diameter D26 of the smaller-diameter portion 512 may be 0.5 mm and 0.3 mm, respectively.

Along the length direction X, the larger-diameter portion 511 and the smaller-diameter portion 512 have different lengths L3 and L5, wherein the length L3 of the larger-diameter portion 511 is larger than the length L5 of the smaller-diameter portion 512. The larger-diameter portion 511 and the smaller-diameter portion 512 are axially aligned with each other.

As with the second hole 51 of the resonator unit Q1, the second hole 52 of the resonator unit Q2 is also configured to have a larger-diameter portion 521 and a smaller-diameter portion 522 (see FIG. 10). The larger-diameter portion 521 extends along the length direction X with one end opening on the third surface 23. The larger-diameter portion 521 is of a substantially circular shape with an inner diameter D22.

The smaller-diameter portion 522 extends along the length direction X with one end connected to the other end of the larger-diameter portion 521. The other end of the smaller-diameter portion 522 is connected to the first hole 42. The smaller-diameter portion 522 is of a substantially circular shape with an inner diameter D27, which is smaller than the inner diameter D22 of the larger-diameter portion 521. For example, the inner diameter D22 of the larger-diameter portion 521 and the inner diameter D27 of the smaller-diameter portion 522 may be 0.5 mm and 0.3 mm, respectively.

Along the length direction X, the larger-diameter portion 521 and the smaller-diameter portion 522 have different lengths, wherein the length of the larger-diameter portion 521 is larger than the length of the smaller-diameter portion 522. The larger-diameter portion 521 and the smaller-diameter portion 522 are axially aligned with each other. Since the further detailed configuration of the resonator units Q1, Q2 is the same as described with reference to FIGS. 1 to 4, redundant explanation is omitted.

In the dielectric filter illustrated in FIGS. 7 to 10, since the resonator unit Q2 has the same configuration as the resonator unit Q1, the foregoing explanation about the effects and advantages of the resonator unit Q1 can be employed for the resonator unit Q2. Concerning the effects of the whole dielectric filter, furthermore, the coupling between the resonator units Q1, Q2 should be considered.

As described with reference to FIG. 10, the second hole 51 of the resonator unit Q1 has the larger-diameter portion 511 and the smaller-diameter portion 512, wherein the larger-diameter portion 511 has one end opening on the third surface 23, the smaller-diameter portion 512 has one end connected to the other end of the larger-diameter portion 511, and the other end of the smaller-diameter portion 512 is connected to the first hole 41. With this configuration, excellent formability of the dielectric material can be ensured at the junction of the first and second holes 41, 51 by the smaller-diameter portion 512, while a capacitance C04 between the internal conductors 81, 82 can be increased by the larger-diameter portion 511 to increase the inductive coupling between the adjacent resonator units Q1, Q2, thereby widening the band of the dielectric filter.

Likewise, the second hole 52 of the resonator unit Q2 has the larger-diameter portion 521 and the smaller-diameter portion 522, wherein the larger-diameter portion 521 has one end opening on the third surface 23, the smaller-diameter portion 522 has one end connected to the other end of the larger-diameter portion 521, and the other end of the smaller-diameter portion 522 is connected to the first hole 42. With this configuration, excellent formability of the dielectric material can be ensured at the junction of the first and second holes 42, 52 by the smaller-diameter portion 522, while the capacitance C04 between the internal conductors 81, 82 can be further increased by the larger-diameter portion 521.

Referring now to FIG. 8, the second surface 22 of the dielectric substrate 1 is provided with first and second terminals 11, 12, which may be used as an input-output terminal. The first terminal 11 is opposed to the first hole 41 across the dielectric layer 72 with a thickness d21 and electrically isolated from the external conductor film 3 by an isolating gap g21 (see FIG. 9).

Likewise, the second terminal 12 is opposed to the first hole 42 across the dielectric layer and electrically isolated from the external conductor film 3 by an isolating gap g22.

Between the first and second terminals 11, 12 and the internal conductors 61, 62 of the first holes 41, 42, there is generated a coupling capacitance that depends on the thickness, dielectric constant and area of the dielectric layer. If desired, the first terminal 11, which is provided on the second surface 22 in the illustrated embodiment, may extend from the second surface 22 to the fourth surface 24 or the fifth surface 25. Likewise, the second terminal 12, which is provided on the second surface 22 in the illustrated embodiment, may extend from the second surface 22 to the fourth surface 24 or the sixth surface 26. The insulating gaps g21 and g22 may be connected to each other as one gap.

Figure 11:
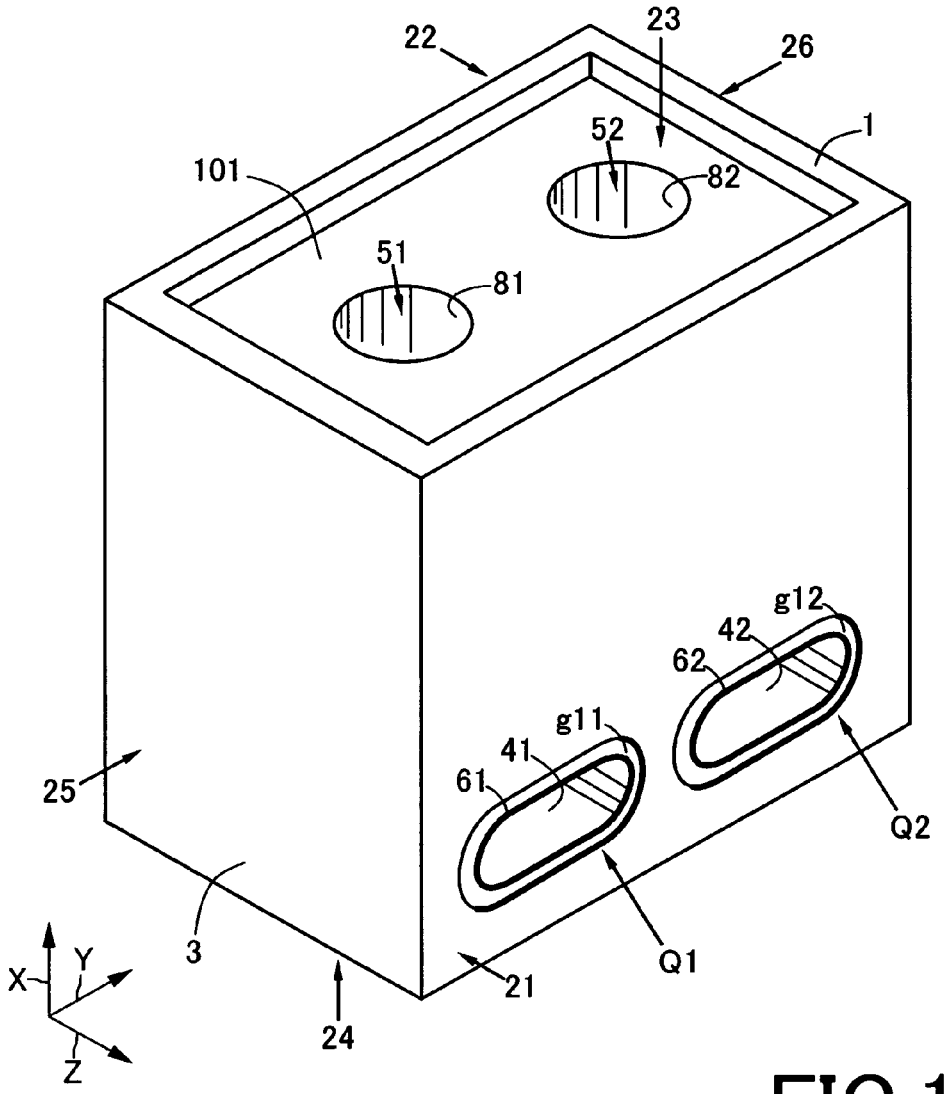
FIG. 11 is a perspective view showing a dielectric filter according to still another embodiment of the present invention.

FIG. 11 is a perspective view showing a dielectric filter according to still another embodiment of the present invention. In this drawing, the components similar to those shown in the foregoing drawings are designated by the same reference symbols, and redundant explanation is omitted. The illustrated dielectric filter also includes one dielectric substrate 1 and two resonator units Q1, Q2. The first and second holes 41, 51 of the resonator unit Q1 and the first and second holes 42, 52 of the resonator unit Q2 may adopt any of the configurations illustrated in and described with reference to FIGS. 1 to 10.

In the embodiment illustrated in FIG. 11, the third surface 23 of the dielectric substrate 1 is stepped to have a recess 101. Both the second holes 51, 52 of the resonator units Q1, Q2 opens into the recess 101.

According to the embodiment illustrated in FIG. 11, coupling characteristics between the resonator units Q1, Q2 and individual resonant frequencies of the resonator units Q1, Q2 can be adjusted by selecting the dimensions of the recess 101.

Figure 12:
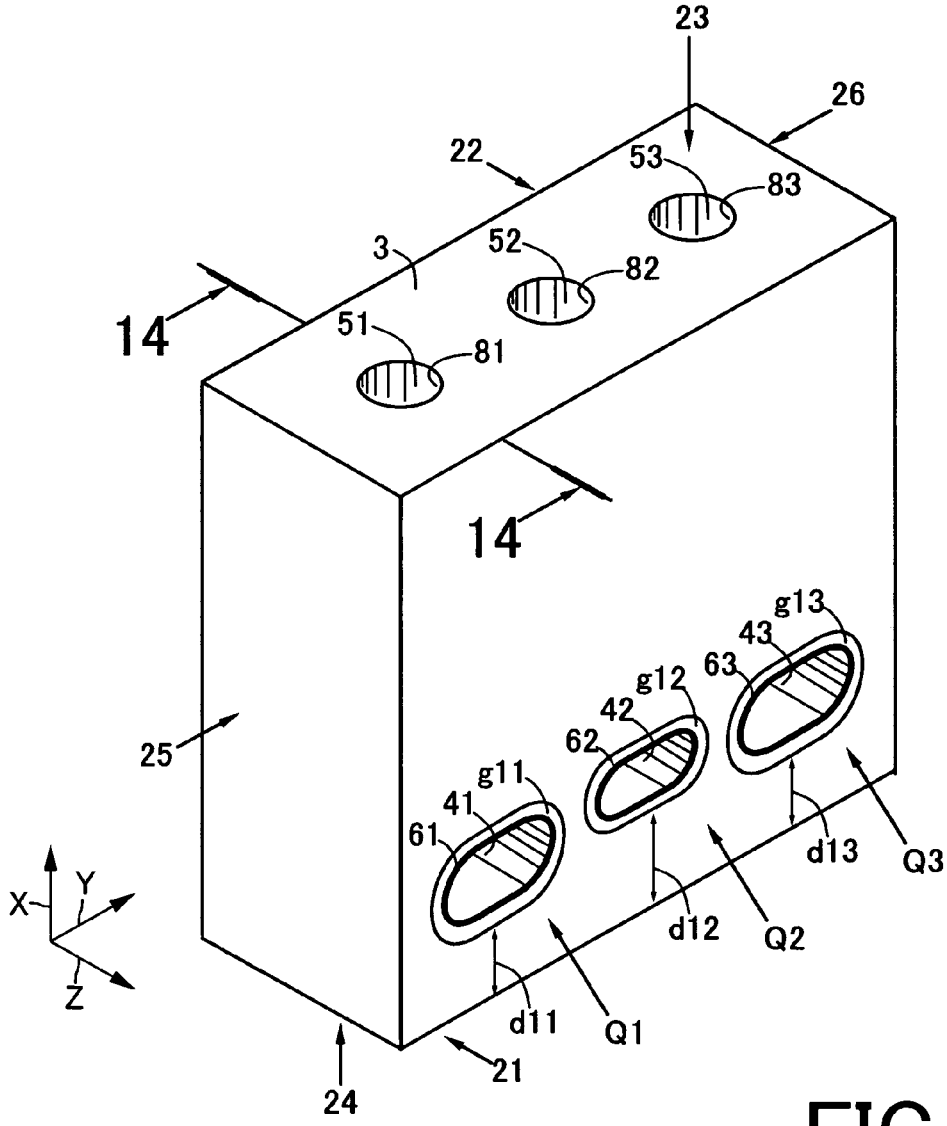
FIG. 12 is a perspective view showing a dielectric filter according to still another embodiment of the present invention.
Figure 13:
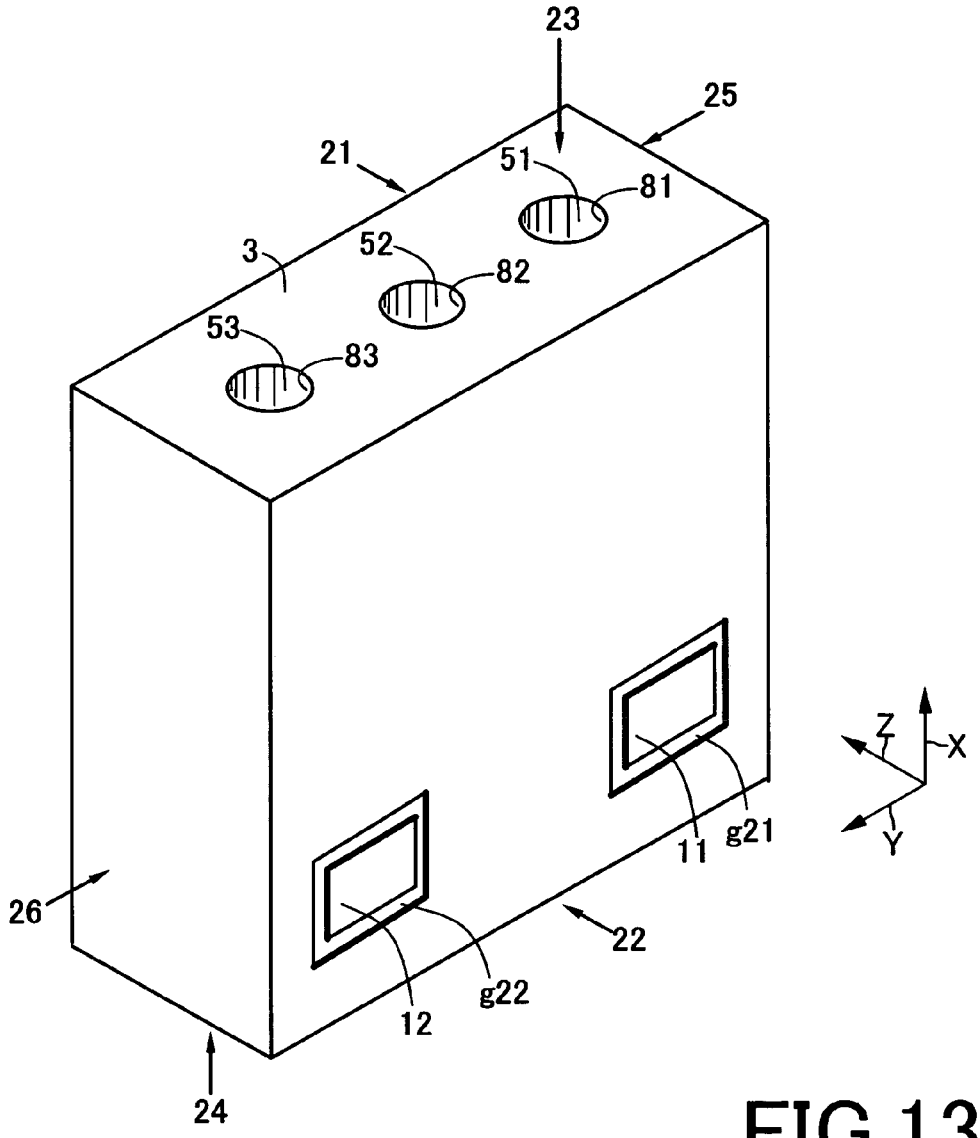
FIG. 13 is a perspective view of the dielectric filter shown in FIG. 12, as seen from a rear side thereof.
Figure 14:
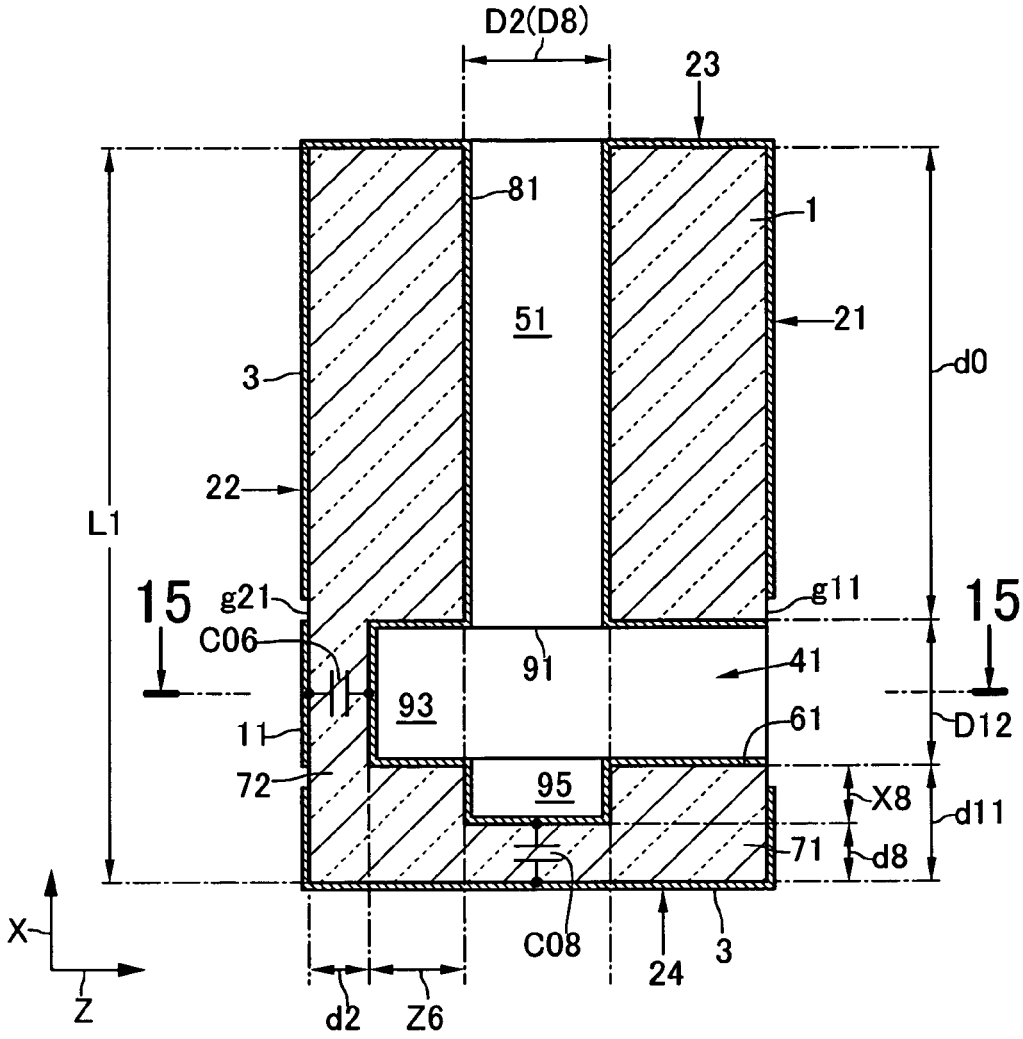
FIG. 14 is a cross-sectional view taken along line 14-14 in FIG. 12.
Figure 15:
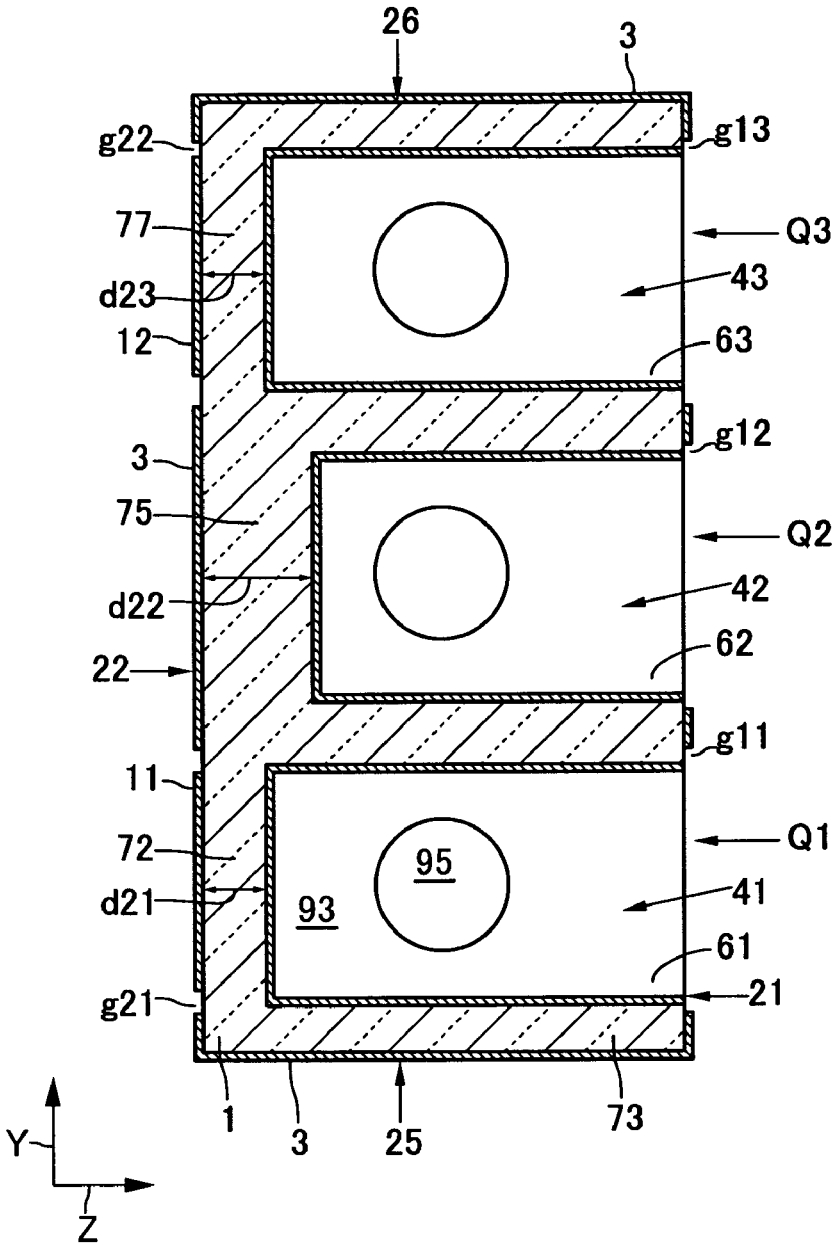
FIG. 15 is a cross-sectional view taken along line 15-15 in FIG. 14.

FIG. 12 is a perspective view showing a dielectric filter according to still another embodiment of the present invention; FIG. 13 is a perspective view of the dielectric filter shown in FIG. 12, as seen from a rear side thereof; FIG. 14 is a cross-sectional view taken along line 14-14 in FIG. 12; and FIG. 15 is a cross-sectional view taken along line 15-15 in FIG. 14. In these drawings, the components similar to those shown in the foregoing drawings are designated by the same reference symbols, and redundant explanation is omitted. The illustrated dielectric filter includes one dielectric substrate 1 and three resonator units Q1 to Q3.

The resonator units Q1, Q2, Q3 share the dielectric substrate 1 and are integrated via the dielectric substrate 1. Of the dielectric substrate 1, most of the second to sixth surfaces 22 to 26 are covered with the external conductor film 3.

The resonator unit Q1 includes first and second holes 41, 51. The resonator unit Q2 includes first and second holes 42, 52. The resonator unit Q3 includes first and second holes 43, 53. The first holes 41, 43 and the second holes 51, 53 of the resonator units Q1, Q3 may adopt any of the configurations illustrated in and described with reference to FIGS. 1 to 11. The first hole 42 and the second hole 52 of the resonator unit Q2 may also adopt any of the configurations illustrated in and described with reference to FIGS. 1 to 11, except for not having any terminal opposed to the first hole 42. In the illustrated embodiment, all the first holes 41 to 43 of the resonator units Q1 to Q3 are configured to have the recess shown in FIG. 3 or 6, but they should not be construed as limited thereto. For example, only the first holes 41, 43 of the resonator units Q1, Q3 may be configured to have the recess. If necessary, at least one of the second holes 51 to 53 of the resonator units Q1 to Q3 may be configured to have the larger-diameter portion and the smaller-diameter portion shown in FIGS. 9 and 10.

In the illustrated embodiment, the first hole 42 of the resonator unit Q2, which is located between the resonator units Q1, Q3, has a smaller inner diameter along the length direction X than those of the resonator unit Q1, Q3, and the dielectric layer 71 at the resonator unit Q2 has a thickness d12 which is larger than thicknesses d11, d13 of the dielectric layer 71 at the resonator units Q1, Q3 (see FIGS. 12, 14). Moreover, the first hole 42 of the resonator unit Q2 is shorter than the first holes 41, 43 of the resonator units Q1, Q3 along the thickness direction Z, and the dielectric layer 75 at the resonator unit Q2 has a thickness d22 which is larger than thicknesses d21, d23 of the dielectric layer 72, 77 at the resonator units Q1, Q3 (see FIG. 15).

The first terminal 11 is provided on the second surface 22, opposed to the first hole 41 of the resonator unit Q1, and electrically isolated from the external conductor film 3 by the isolating gap g21. If desired, the first terminal 11, which is provided on the second surface 22 in the illustrated embodiment, may extend from the second surface 22 to the fourth surface 24 or the fifth surface 25.

The second terminal 12 is provided on the second surface 22, opposed to the first hole 43 of the resonator unit Q3, and electrically isolated from the external conductor film 3 by the isolating gap g22. If desired, the second terminal 12, which is provided on the second surface 22 in the illustrated embodiment, may extend from the second surface 22 to the fourth surface 24 or the sixth surface 26.

Figure 16:
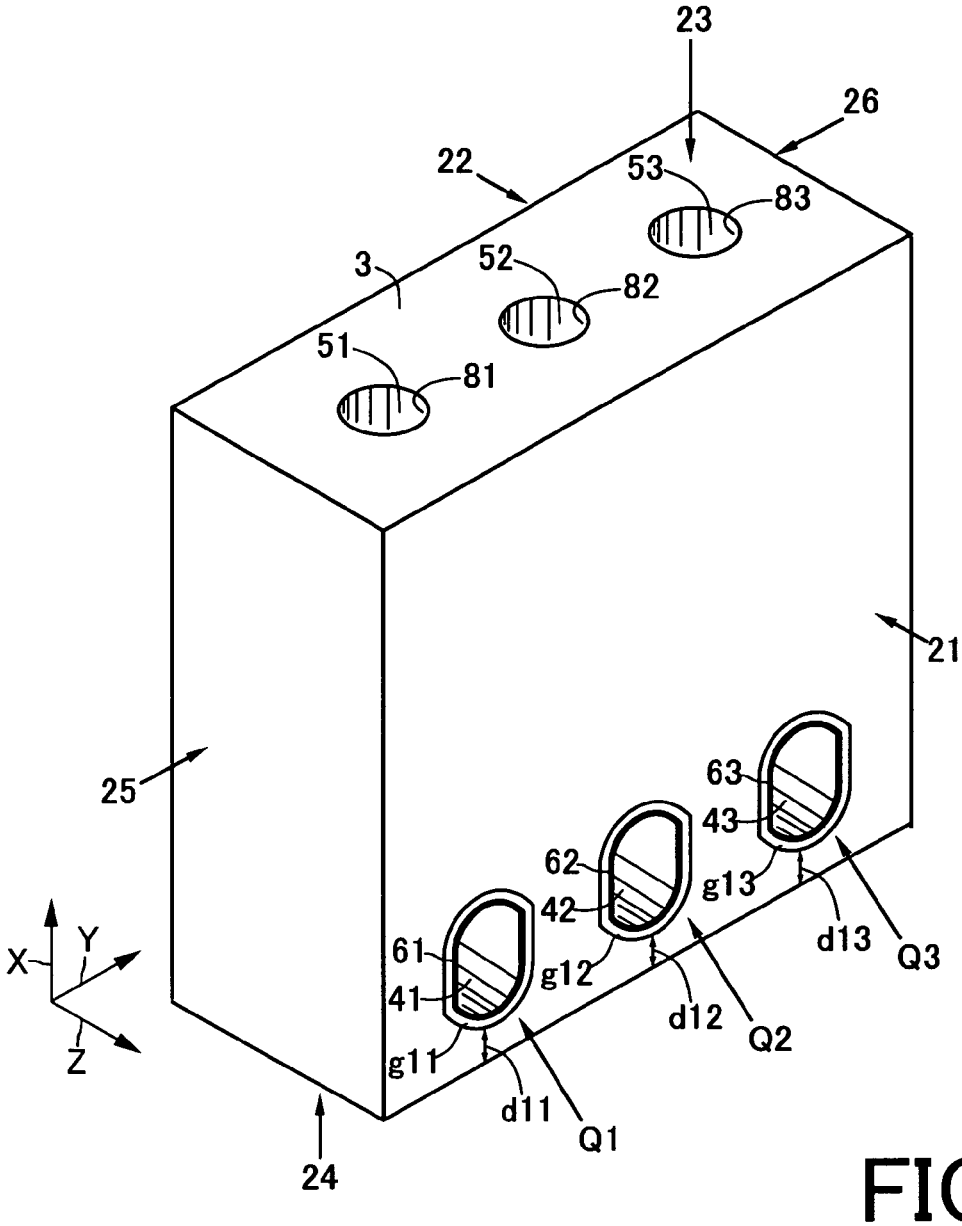
FIG. 16 is a perspective view showing a dielectric filter according to still another embodiment of the present invention.

FIG. 16 is a perspective view showing a dielectric filter according to still another embodiment of the present invention. The embodiment illustrated in FIG. 16 has the same basic structure as the embodiment illustrated in FIGS. 12 to 15, but differs in that the first holes 41 to 43 of the resonator units Q1 to Q3 are elongated in the length direction X, that the first holes 41 to 43 are spaced apart more than in FIGS. 12 to 15, and that the thicknesses d11, d12, d13 of the dielectric layer, which correspond to the distances between the external conductor film 3 and the first holes 41 to 43, are smaller than those in FIGS. 12 to 15.

The dielectric device according to the present invention may be used as a wide variety of devices including a dielectric resonator, a dielectric filter, and a duplexer. Among them, the dielectric resonator and the dielectric filter have been described in detail with reference to FIGS. 1 to 16. Due to space limitations, no further description will be made thereof, but it is obvious that the dielectric device can be provided with a larger number of resonator units and that there are a large number of possible combinations of the illustrated and described embodiments.

Next, there will be described a duplexer, which is another important application of the dielectric device according to the present invention.

Figure 17:
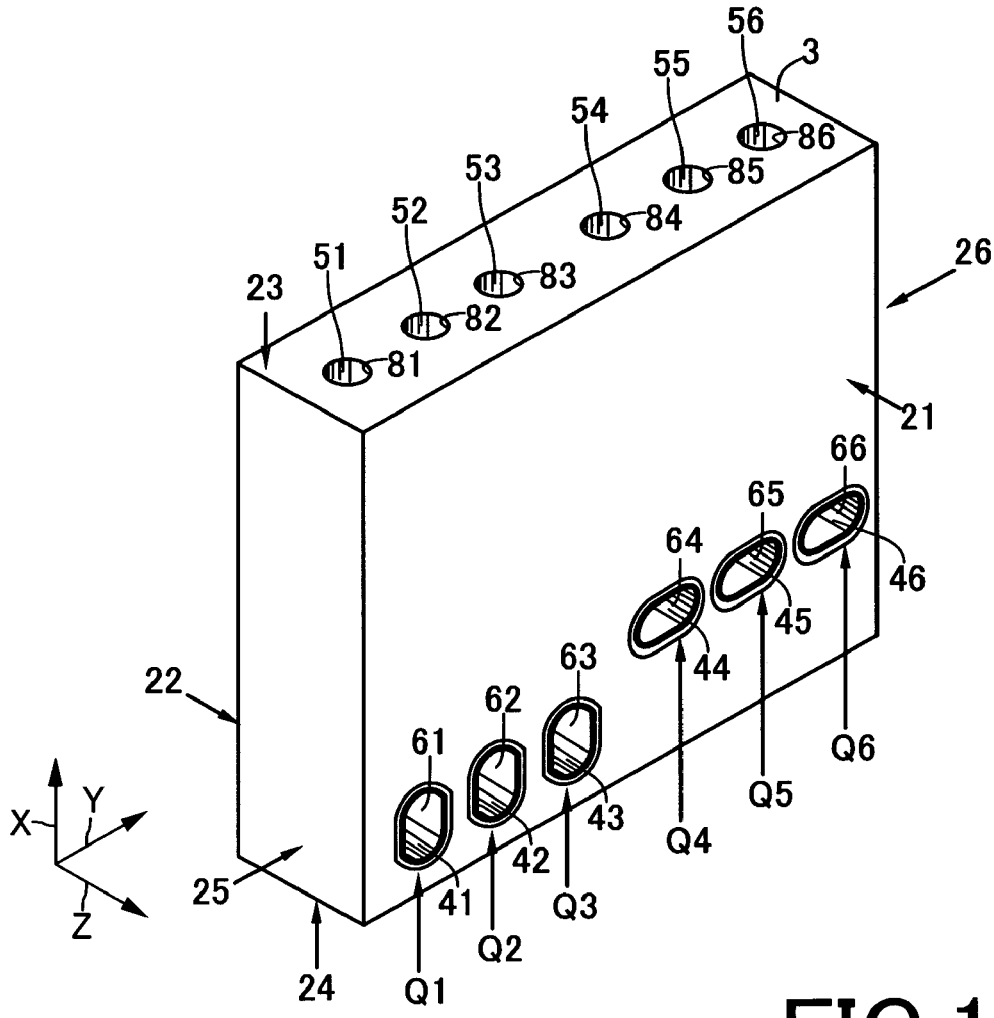
FIG. 17 is a perspective view showing a duplexer according to still another embodiment of the present invention.
Figure 18:
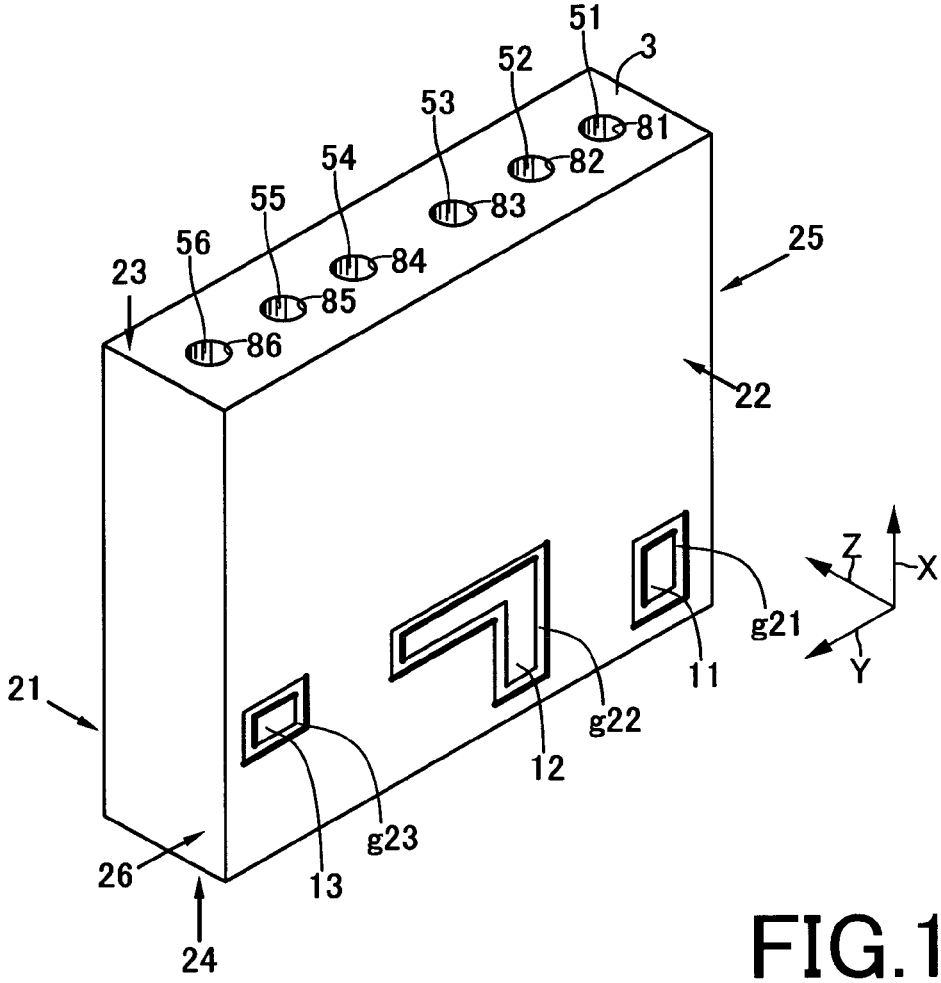
FIG. 18 is a perspective view of the duplexer shown in FIG. 17, as seen from a rear side thereof.

FIG. 17 is a perspective view showing a duplexer according to still another embodiment of the present invention; and FIG. 18 is a perspective view of the duplexer shown in FIG. 17, as seen from a rear side thereof. In these drawings, the components similar to those shown in the foregoing drawings are designated by the same reference symbols, and redundant explanation is omitted. The illustrated duplexer includes six resonator units Q1 to Q6. The resonator units Q1 to Q6 share the dielectric substrate 1 and are integrated via the dielectric substrate 1. Of the dielectric substrate 1, most of the second to sixth surfaces 22 to 26 are covered with the external conductor film 3.

Among the resonator units Q1 to Q6, the resonator unit Q1 includes a combination of first and second holes 41, 51, the resonator unit Q2 includes a combination of first and second holes 42, 52, and resonator unit Q3 includes a combination of first and second holes 43, 53; the resonator unit Q4 includes a combination of first and second holes 44, 54, the resonator unit Q5 includes a combination of first and second holes 45, 55, and resonator unit Q6 includes a combination of first and second holes 46, 56.

The first hole (41 to 46) and the second hole (51 to 56) may be configured and related to each other as described with reference to FIGS. 1 to 16. For example, at least one of the first holes 41 to 46 may be configured to have the recess shown in FIG. 3 or 6. In addition, at least one of the second holes 51 to 56 may be configured to have the larger-diameter portion and the smaller-diameter portion shown in FIGS. 9 and 10. The first hole (41 to 46) has the first internal conductor (61 to 66), and the second hole (51 to 56) has the second internal conductor (81 to 86).

Since the duplexer is used as an antenna duplexer, either of two resonator unit groups (the resonator units Q1 to Q3 or the resonator units Q4 to Q6) is used for a transmitter, while the other group is used for a receiver. Since the transmit frequency and the receive frequency are different from each other, the resonance characteristics of the resonator units Q1 to Q3 and the resonance characteristics of the resonator units Q4 to Q6 also should be different from each other.

On the side of the resonator unit Q1 to Q3, a first terminal 11 is provided on the second surface 22 and coupled with the first hole 41 of the resonator unit Q1 via the dielectric layer of the dielectric substrate 1.

On the side of the resonator unit Q4 to Q6, a third terminal 13 is provided on the second surface 22 and coupled with the first hole 46 of the resonator unit Q6 via the dielectric layer of the dielectric substrate 1. Such capacitive coupling has been described hereinabove.

Furthermore, a second terminal 12 for connection with an antenna is coupled with the first holes 43, 44 of the central resonator units Q3, Q4.

The first to third terminals 11 to 13 on the second surface 22 are electrically isolated from the external conductor film 3 by insulating gaps g21 to g23. The first to third terminals 11 to 13 ensure face-to-face attachment to a mounting board.

The first holes 41 to 43 of the resonator units Q1 to Q3 are elongated along the length direction X, while the first hole 44 to 46 of the resonator units Q4 to Q6 are elongated along the width direction Y. In addition, the distance between the external conductor film 3 and the first holes 41 to 43 of the resonator units Q1 to Q3 is smaller than the distance between the external conductor film 3 and the first hole 44 to 46 of the resonator units Q4 to Q6. Therefore, the resonator units Q1 to Q3 exhibit an inductive coupling, while the resonator units Q4 to Q6 exhibit a capacitive coupling.

Although not shown in the drawings, it will be appreciated the configurations described with reference to the dielectric resonator and the dielectric filter (see FIGS. 1 to 16) may also be adopted for a duplexer.

While the present invention has been particularly shown and described with reference to embodiments thereof, it will be understood by those skilled in the art that various changes in form and detail may be made therein without departing from the spirit, scope and teaching of the invention.

What is claimed is:

1. A dielectric device comprising:

a dielectric substrate;

at least one resonator unit; and at least one terminal, said dielectric substrate being shaped to have first and second surfaces opposed to each other in a first direction and third and fourth surfaces opposed to each other in a second direction perpendicular to said first direction, said dielectric substrate having an external conductor film at least on said second, third and fourth surfaces, said resonator unit including first and second holes, said first hole being provided in said dielectric substrate, extending along said first direction with one end thereof opening on said first surface, and having a first internal conductor inside thereof, said second hole being provided in said dielectric substrate, extending along said second direction with one end thereof opening on said third surface and the other end thereof connected to said first hole, and having a second internal conductor inside thereof, said second internal conductor having one end thereof connected to said external conductor film on said third surface and the other end thereof connected to said first internal conductor inside said dielectric substrate, said first hole extending beyond a junction with said second hole to have an extension opposed to said second surface, said terminal being provided on said second surface, separated from said external conductor film by a gap, and opposed to said first internal conductor in said extension of said first hole across said dielectric substrate, said first hole having a recess opposed to said junction along said second direction, said first internal conductor in said recess being opposed said external conductor film on said fourth surface across said dielectric substrate.

2. The dielectric device of claim 1, wherein said first internal conductor is separated from said external conductor film on said first surface by a gap.

3. The dielectric device of claim 1, wherein said recess has an inner diameter equal to that of said second hole.

4. The dielectric device of claim 1, wherein said recess has an inner diameter smaller than that of said second hole.

5. The dielectric device of claim 1, wherein said resonator unit comprises a plurality of resonator units electrically coupled with each other via said dielectric substrate.

6. The dielectric device of claim 5, wherein in at least one of said resonator units, said second hole has a larger-diameter portion and a smaller-diameter portion, wherein said larger-diameter portion has one end thereof opening on said third surface, said smaller-diameter portion has one end thereof connected to the other end of said larger-diameter portion, and the other end of said smaller-diameter portion is connected to said first hole.

7. The dielectric device of claim 6, wherein said larger-diameter portion is longer than said smaller-diameter portion along said second direction.

8. The dielectric device of claim 5, wherein said terminal comprises first and second terminals, said first terminal is provided on said dielectric substrate and electrically coupled with at least one of said resonator units, and said second terminal is provided on said dielectric substrate and electrically coupled with at least another of said resonator units.

9. The dielectric device of claim 5, wherein said resonator units include one common recess where said third surface is recessed to have a step therearound and into which a plurality of second holes open.

10. The dielectric device of claim 5, which is a dielectric filter.

11. The dielectric device of claim 5, which is a duplexer.

12. The dielectric device of claim 11, wherein said resonator unit comprises at least three resonator units and said terminal comprises first, second and third terminals electrically coupled with different resonator units.

13. A dielectric device comprising:

a dielectric substrate; and at least one resonator unit, said dielectric substrate being shaped to have first and second surfaces opposed to each other in a first direction and third and fourth surfaces opposed to each other in a second direction perpendicular to said first direction, said dielectric substrate having an external conductor film at least on said second, third and fourth surfaces, said resonator unit including first and second holes, said first hole being provided in said dielectric substrate, extending along said first direction with one end thereof opening on said first surface, and having a first internal conductor inside thereof, said first internal conductor being separated from said external conductor film on said first surface by a gap, said second hole being provided in said dielectric substrate, extending along said second direction with one end thereof opening on said third surface and the other end thereof connected to said first hole, and having a second internal conductor inside thereof, said second internal conductor having one end thereof connected to said external conductor film on said third surface and the other end thereof connected to said first internal conductor inside said dielectric substrate, said first hole extending beyond a junction with said second hole to have an extension opposed to said second surface, said first hole having a recess opposed to said junction along said second direction, said first internal conductor in said recess being opposed said external conductor film on said fourth surface across said dielectric substrate.

14. The dielectric device of claim 13, wherein said recess has an inner diameter equal to that of said second hole.

15. The dielectric device of claim 13, wherein said recess has an inner diameter smaller than that of said second hole.

16. The dielectric device of claim 13, wherein said resonator unit comprises a plurality of resonator units electrically coupled with each other via said dielectric substrate.

17. The dielectric device of claim 16, wherein in at least one of said resonator units, said second hole has a larger-diameter portion and a smaller-diameter portion, wherein said larger-diameter portion has one end thereof opening on said third surface, said smaller-diameter portion has one end thereof connected to the other end of said larger-diameter portion, and the other end of said smaller-diameter portion is connected to said first hole.

18. The dielectric device of claim 17, wherein said larger-diameter portion is longer than said smaller-diameter portion along said second direction.

19. The dielectric device of claim 16, further comprises first and second terminals, said first terminal is provided on said dielectric substrate and electrically coupled with at least one of said resonator units, and said second terminal is provided on said dielectric substrate and electrically coupled with at least another of said resonator units.

20. The dielectric device of claim 16, wherein said resonator units include one common recess where said third surface is recessed to have a step therearound and into which a plurality of second holes open.

21. The dielectric device of claim 16, which is a dielectric filter.

22. The dielectric device of claim 16, which is a duplexer.

23. The dielectric device of claim 22, comprising first, second and third terminals, wherein said resonator unit comprises at least three resonator units and said first, second and third terminals are electrically coupled with different resonator units.

* * * * *